United States Patent [19]

Iwata

[11] Patent Number: 4,716,517

[45] Date of Patent: Dec. 29, 1987

[54] APPARATUS FOR CONTROLLING AN ELEVATOR

[75] Inventor: Shigemi Iwata, Aichi, Japan

[73] Assignee: Mitsubishi Denki Kabushiki Kaisha, Japan

[21] Appl. No.: 774,886

[22] Filed: Sep. 11, 1985

[51] Int. Cl.[4] ..... B66B 3/02

[52] U.S. Cl. ..... 364/148; 364/561; 187/134

[58] Field of Search ..... 364/148, 151, 170, 561, 364/562, 184; 340/21; 187/29 R, 29 V, 29 E, 29 F, 29 P

[56] References Cited

U.S. PATENT DOCUMENTS

| | | | |
|---|---|---|---|
| 4,341,287 | 7/1982 | Kuzuniki | 187/29 R |
| 4,367,811 | 1/1983 | Yoneda | 187/29 R |
| 4,387,436 | 6/1983 | Katayama | 340/21 |
| 4,493,399 | 1/1985 | Kajiyama | 187/29 R |
| 4,520,904 | 6/1985 | Rado | 187/29 R |

*Primary Examiner*—Jerry Smith
*Assistant Examiner*—Allen MacDonald
*Attorney, Agent, or Firm*—Leydig, Voit & Mayer

[57] ABSTRACT

The actual floor level of each of the floors of a building is determined and stored as a data point in memory by detecting, for each floor, the position of a point located a predetermined distance above the floor level and the position of a point located a predetermined distance below the floor level, storing data representing the above and below points in memory, and calculating a data point for the actual floor level located at the mid-point between the points above and below the actual floor level in the case where the points are the same predetermined distance above and below the actual floor level. The data stored in memory as to the positions of the points is continuously updated each time the elevator cage passes by each floor, and the data point of the actual floor level is recalculated to provide an updated and accurate representation of the actual floor level in memory to account for cable stretch and other mechanical or electronic variations. The positions of the points are determined by counting pulses generated responsive to cage movement.

7 Claims, 13 Drawing Figures

APPARATUS FOR CONTROLLING AN ELEVATOR

BACKGROUND OF THE INVENTION

The present invention relates to an apparatus for controlling an elevator and, more particularly, to an apparatus having a microcomputer for controlling an elevator.

FIG. 1 is a diagram showing the schematic construction of an apparatus including a microcomputer for controlling the operation of an elevator as it is moved between a plurality of floors. In FIG. 1, reference numeral 1 denotes a cage of an elevator, numeral 2 a balance weight, and numeral 3 a cable engaged on a sheave 4. The cage 1 and the weight 2 are connected to both ends of the cable 3. Reference numeral 5 denotes an electric motor for driving the sheave 4, numeral 6 a pulse generator for generating a pulse proportional to the moving distance of the cage 1 by the rotation of the motor 5, and numeral 7 a counter circuit for counting the number of pulses generated from the pulse generator 6. A microcomputer 8 which includes, as shown in FIG. 3, a CPU 8*a*, a ROM 8*b*, a RAM 8*c*, an input port 8*d*, and an output port 8*e*, receives a signal from the counter circuit 7 at the input port 8*d* and generates an output signal at the output port 8*e*. Reference numeral 9 denotes a floor, numeral 10 plates provided in a hoistway corresponding to the floors, and numerals 11 and 12 position detectors provided in the cage 1 for producing output signals 11*a* and 12*a* when the cage 1 reaches a position about 10 mm lower and about 10 mm higher than the level of each floor, respectively. These output signals 11*a* and 12*a* are then sent to the counter circuit 7 and the microcomputer 8.

FIG. 2 shows a diagram iof the detailed arrangement of the counter circuit 7 illustrated in FIG. 1. As shown, the counter circuit 7 includes a pair of 4-bit binary counters CT1 and CT2. An output pulse 6*a* from the pulse generator 6 is applied directly to a terminal T of the counter CT1 and to a terminal T of the counter CT2 through a NAND gate NAND1 and a NOT gate NOT1 to count running pulses of the cage 1 during the calculating period of the microcomputer 8 and to store the counted pulses to be delivered to the CPU 8*a* through the input port 8*d* in the next inputting process. The counter circuit 7 further includes a pair of R-S flip-flops (hereinafter referred to as "flip-flops") FF1 and FF2 having the set terminals S connected to the outputs of NAND gates NAND2 and NAND3, respectively. An up signal UP generated from the microcomputer 8, an output signal 11*a* from the position detector 11, and a signal produced by passing the output signal 11*a* through a NOT gate NOT2 and a time constant circuit of a resistor R1 and a capacitor C1 are all applied to the input of the NAND gate NAND 2. A down signal DN generated from the microcomputer 8, an output signal 12*a* from the position detector 12, and a signal produced by passing the output signal 12*a* through a NOT gate NOT3 and a time constant circuit of a resistor R2 and a capacitor C2 are applied to the input of the NAND gate NAND3. Further, the outputs Q of the flip-flops FF1 and FF2 are connected to the inputs of an OR gate OR1, and the output signal of the OR gate OR1 is applied to the other input of the NAND gate NAND1. Thus, the counter CT2 stops the counting operation at every rising time of the output signal of the position detector 11 or 12. A reset signal RESET generated from the microcomputer 8 is applied to the counters CT1 and CT2 and the reset terminals R of the flip-flops FF1 and FF2.

FIG. 4 shows the storage memory address of the RAM 8*c* of the microcomputer 8 which stores the level position data representing the levels of N respective floors in a building wherein FLH(0) denotes the level of the lowermost floor, and FLH(N−1) denotes the level of the uppermost floor.

The operation of the above-described apparatus for controlling the elevator will now be explained.

First, the writing operation of the floor numbers of respective floors in the RAM 8*c* will be described with reference to the flow chart of FIG. 5.

(a) The microcomputer 8 is first initialized, and the cage 1 is stopped at the lowermost floor. The level corresponding to the lowermost floor is, for example, determined to have a reference value L, and this is written in the address "0" of the RAM 8*c* as FLH(0). At this time, the present position FSY of the cage has a value $L_0$.

(b) Then, the cage 1 is run upward, and the pulse generated from the pulse generator 6 is counter by the counters CT1, CT2 to measure the running distance of the cage. As shown in FIG. 5, upon the start of the writing and calculating program of the microcomputer 8, the counted values DP1 and DP2 of the counters CT1 and CT2 are input to the microcomputer 8 in step 100, and the reset signal RESET is delivered from the microcomputer 8 in the next step 101 to reset the counters CT1 and CT2 and the flip-flops FF1 and FF2. When the resetting operation is finished, the next step 102 determines whether the cage 1 is running upward, and, upon a "NO", the writing and calculating program is terminated. The next step 103 determines whether the output signal 11*a* of the position detector 11 increases, and, upon a "NO", the program advances directly to step 106 wherein the counted value DP1 of the counter CT1 is accumulated by the microcomputer 8 according to process FSY−FSY+DP1. The FSY is the present position of the cage 1, and the processes in the steps 100 to 103 and 106 are continuously executed during the running of the cage at every calculating period of the microcomputer 8.

(c) When the cage 1 goes up and arrives at the level of the next floor, the output signal 11*a* of the position detector 11 is detected by the microcomputer 8. This, in turn, provides a "YES" result in step 103. Then, the program advances to step 104, and the process of I+1 is executed so that a new floor number is written in the RAM 8*c*. The program proceeds to step 105, and the counted value DP2 of the counter CT2 is added to the present position FSY to provide the floor number calculated value FLH(I) to be written in the corresponding address I of the RAM 8*c*.

Similarly, the writing and calculations from step 100 to step 106 are repeated for subsequent floors up to the uppermost floor, and, in this particularr case, floor numbers FLH(0) to FLH(N−1) corresponding to the levels of N respective floors are written in the RAM 8*c*, as shown in FIG. 4.

The floor numbers obtained in this manner are utilized for the ordinary operation of the elevator. In other words, the floor numbers stored in the RAM 8*c* are used for the correction of the present position of the cage, the running distance of the cage from the departing floor to the destination floor, the remaining distance to the destination floor, and the reference speed command corresponding to the remaining distance.

However, the conventional writing and calculation program for the floor numbers as described above produces the following disadvantages.

(a) When a cage is displaced from a level at a floor, the present position of the cage at other floors cannot be corrected.

(b) Even if a certain door zone (the zone for opening or closing the door) is provided to accommodate the displacement of the cage when the elevator is first started, the level of the respective floors cannot be accurately corrected due to the wear of the sheave resulting from its extensive use in a prolonged period of time. In other words, even when a length LDZ of the door zone (stored in advance as a fixed value in the ROM) is taken into account in the determination of the present position of the cage, that is, the present position FSY satisfies the equation $$FSY-FLH(I)+LDZ/2,$$

where I denotes the starting floor, accurate correction cannot be performed since this length is a fixed value and not related to or affected by wear of the sheave.

(c) The level of the floor of the building is not accurately stored in memory. In other words, the position detector does not accurately detect the position of 10 mm above the floor. Thus, there is a difference of 10 mm in the value of floor number FLH(I). Therefore, even if the calculation of FLH(I)−FSY (present position) is, for example, executed so as to obtain the remaining distance, a displacement of 10 mm occurs, thereby lowering the stopping accuracy of the cage.

SUMMARY OF THE INVENTION

An object of the present invention is to eliminate the above-described drawbacks, and its main object is to provide an elevator control apparatus which can accurately store and correct level data of respective floors for producing the present position of an elevator cage, the remaining distance of the cage to a destination floor, and the reference speed command of the cage even if the cage operates from an out-of-level starting position.

DESCRIPTION OF THE PREFERRED EMBODIMENT

An embodiment of the invention will be described below in conjunction with the accompanying drawings.

Figure 2:
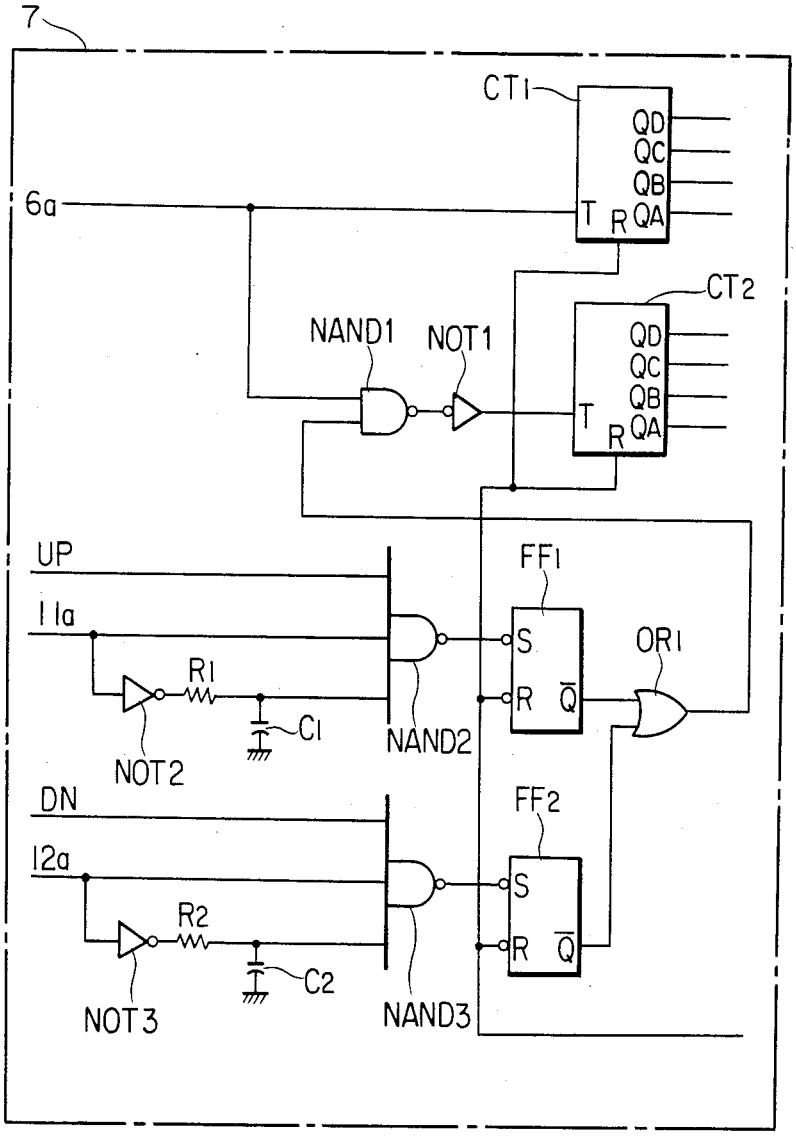
FIG. 2 PRIOR ART
FIG. 2 is a diagram showing the detail of the counter circuit of the conventional apparatus for controlling the elevator.
Figure 3:
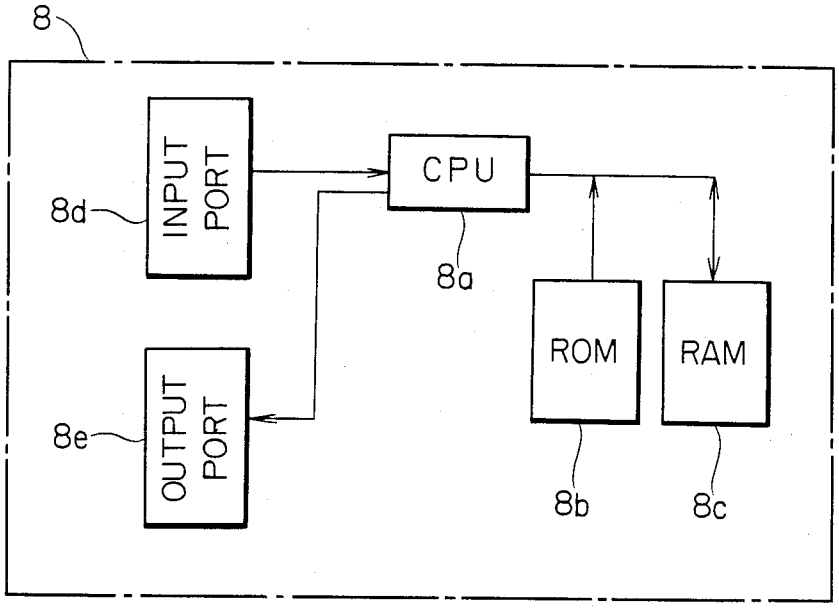
FIG. 3 is a schematic diagram showing the construction of a microcomputer in FIG. 1.
Figure 4:
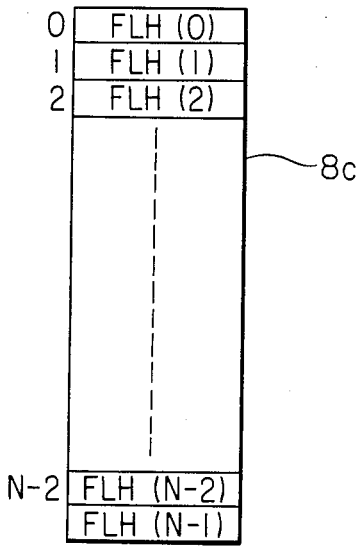
FIG. 4 PRIOR ART
FIG. 4 is an explanatory view of a RAM for storing the level position data of the conventional apparatus.
Figure 5:
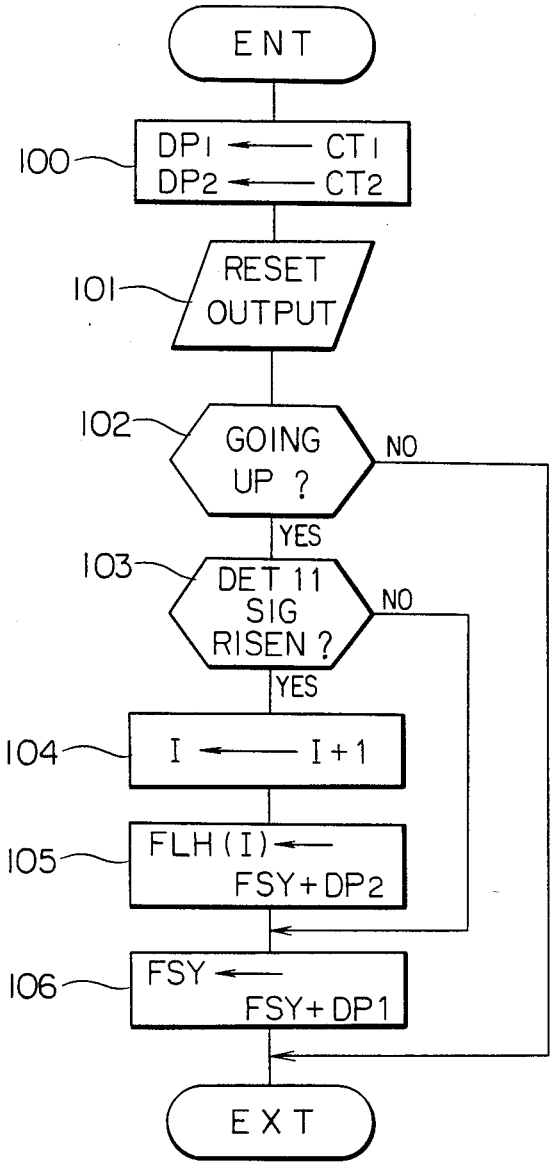
FIG. 5 PRIOR ART
FIG. 5 is a diagram showing a flow chart for writing the level position data in the conventional RAM.
Figure 6:
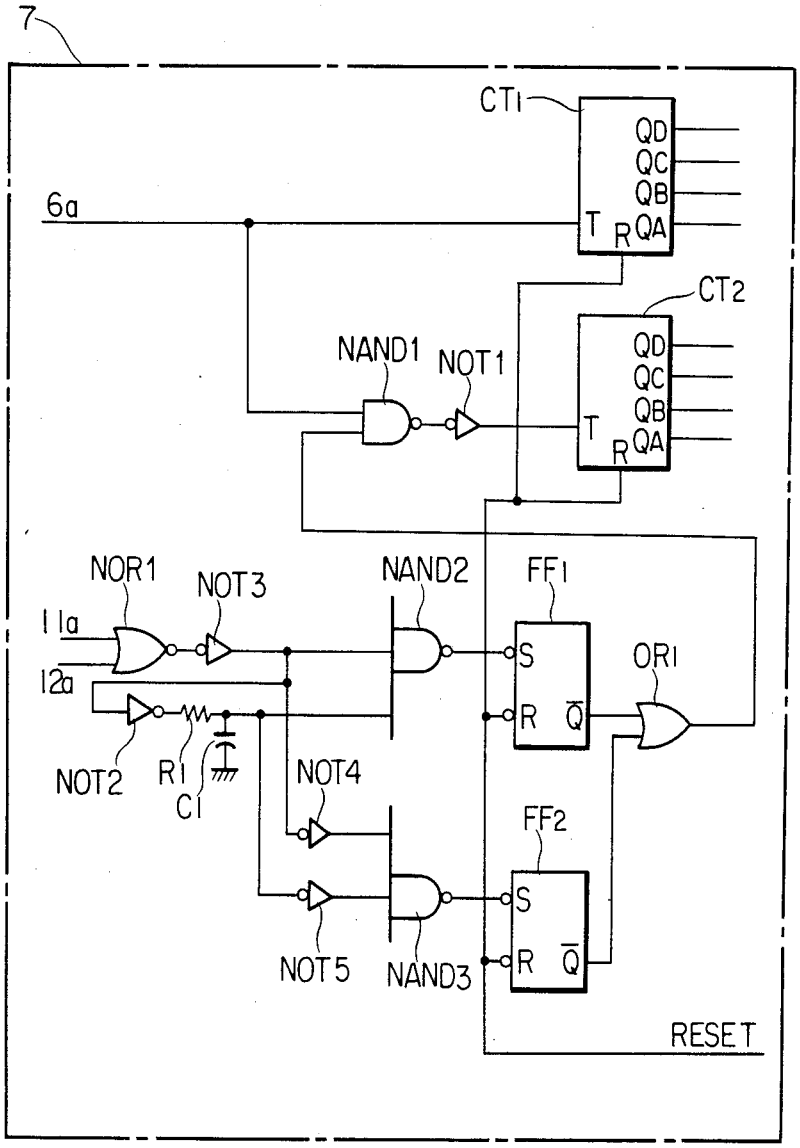
FIG. 6 is a diagram showing the construction of a counter circuit in an apparatus for controlling an elevator according to a first embodiment of the present invention.

FIG. 6 shows an example of a counter circuit in an apparatus for controlling an elevator according to the present invention wherein the same reference numerals as those in FIG. 2 designate the same or equivalent elements. The description of the same elements will be omitted, and the portion different from that in FIG. 2 will be described in detail.

More particularly, the primary difference from FIG. 2 is that the logic sum of the output signals 11*a* and 12*a* of the position detectors 11 and 12 is taken and the counter CT2 stops counting when a signal representing the logic sum changes.

Figure 1:
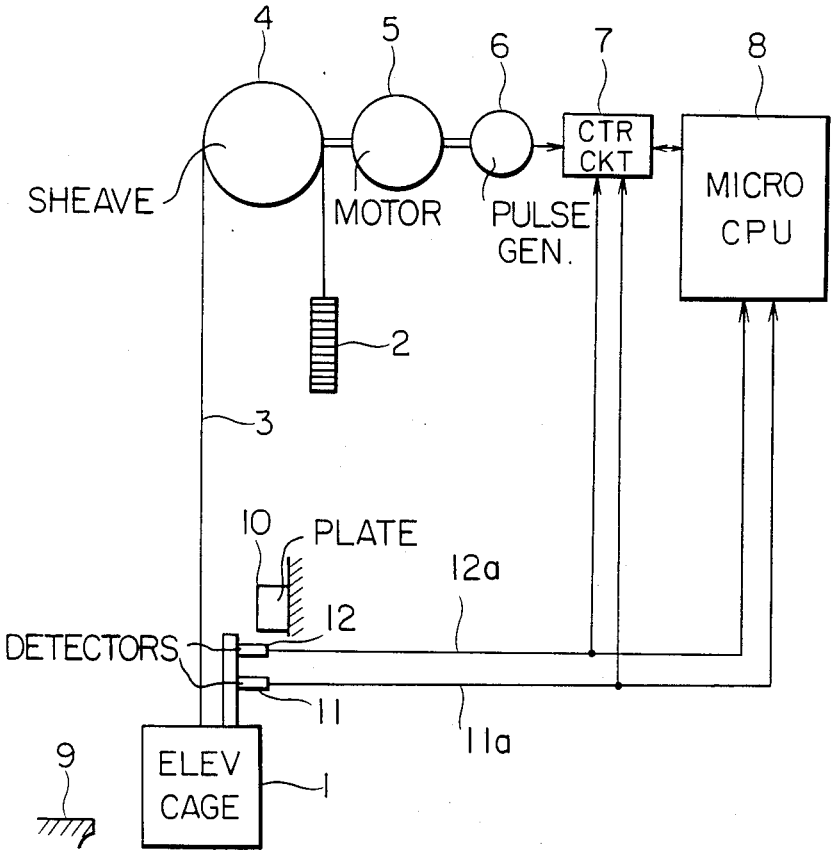
FIG. 1 is a diagram showing the entire construction of a conventional apparatus for controlling an elevator.

To this end, in this embodiment, a NOR gate NOR1 for producing the logic sum of the output signals 11*a* and 12*a* of the positions detectors 11 and 12 in FIG. 1 is provided, the output signal of the NOR gate NOR1 is applied to one input of a NAND gate NAND2 through a NOT gate NOT3, and a signal obtained from the NOT gate NOT3 is passed through a NOT gate NOT2 and a time constant circuit of a resistor R1 and a capacitor C1 is applied to the other input of the NAND gate NAND2. A signal obtained through the NOT gate NOT3 or the NOT gate NOT2 and the time constant circuit is applied to the two inputs of the NAND gate NAND3 through NOT gates NOT4 and NOT5. Thus, when the flip-flops FF1 and FF2 are set by the outputs of the NAND gates NAND2 and NAND3, the counting stop is applied to the counter CT2.

Figure 8:
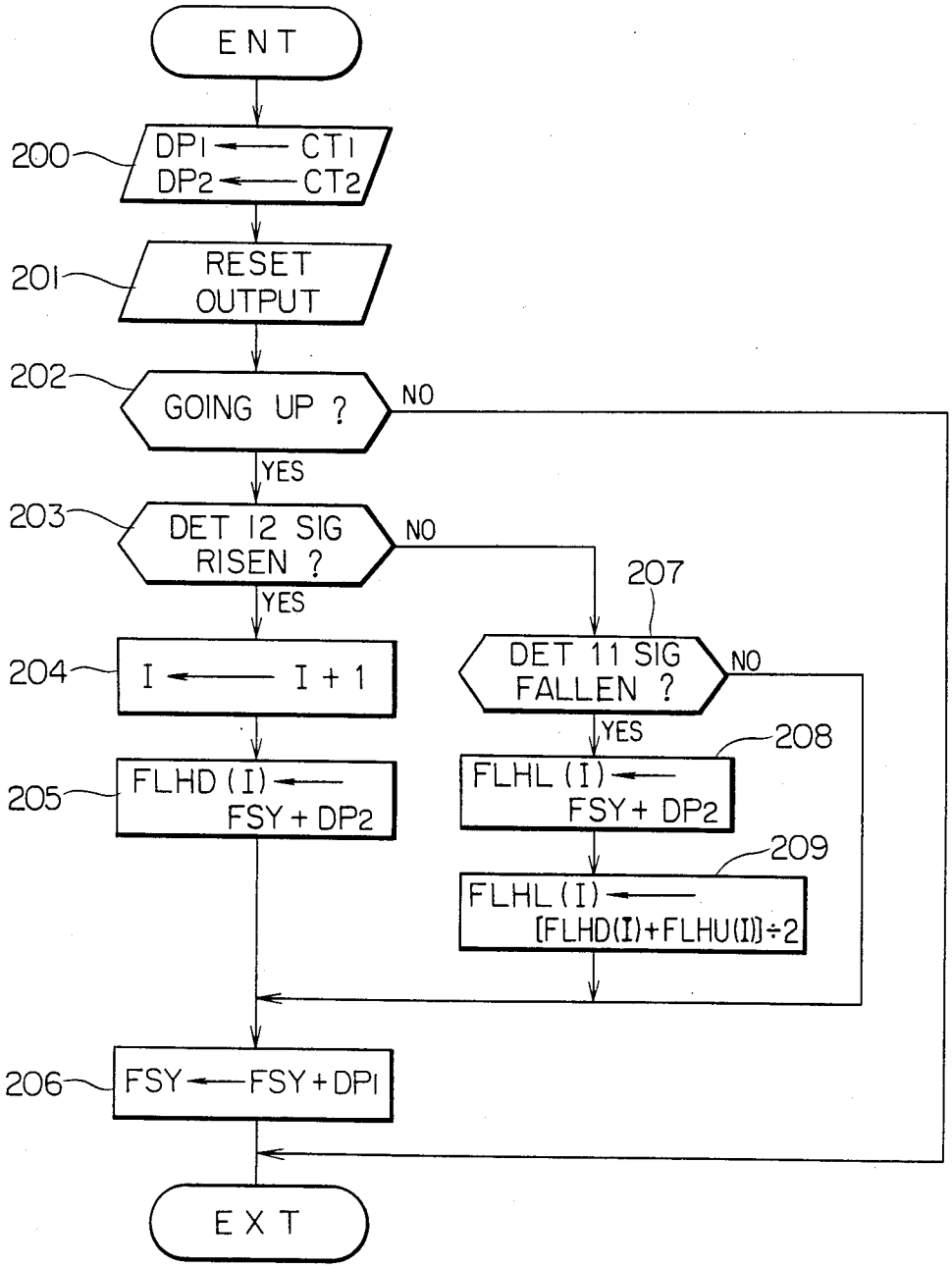
FIG. 8 is a diagram of a flow chart for writing the level position data in the RAM of the apparatus of the invention.

When the counted value obtained from the counter circuit 7 of the arrangement described above is inputted to the microcomputer and calculated as shown in FIG. 8, the level values of the respective floors can be accurately provided.

More specifically, the position detectors 11 and 12 are provided to detect the positions (e.g., 10 mm below the floor) spaced from the level of the floor, but the actual operating point is continued to be changed, from example, from 10 mm below the floor to 300 mm above the floor. Therefore, the present invention is operated to determine the level value FLHD(I) considered at a position 300 mm below the floor and the level value FLHU(I) considered at a position 300 mm above the floor and to write the level values in the RAM 8*c* of the microcomputer 8 and then calculate (FLHD(I)+FLHU(I))/2 on the basis of these level values, thereby obtaining the actual level values of the respective floors and storing them in the RAM 8*c* for the correction of the selector and the calculation of the remaining distance.

The writing operation of the level data of the respective floors in the embodiment described above according to the present invention will be described on the basis of the flow chart of FIG. 8.

Figure 7:
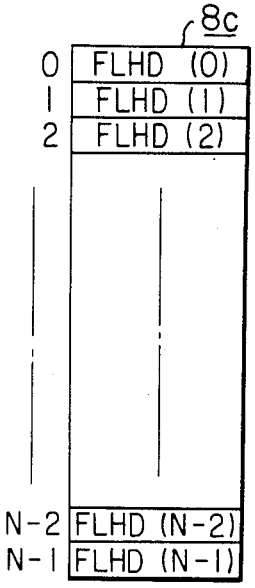
FIGS. 7(*a*) to 7(*c*) are explanatory views of the RAM in the apparatus of the present invention.
Figure 7:
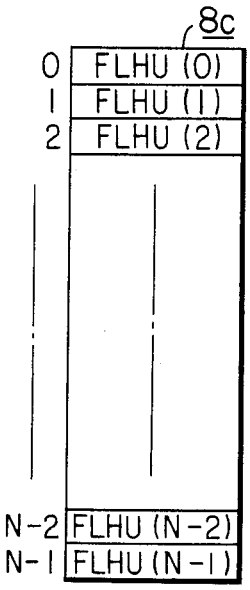
Figure 7:
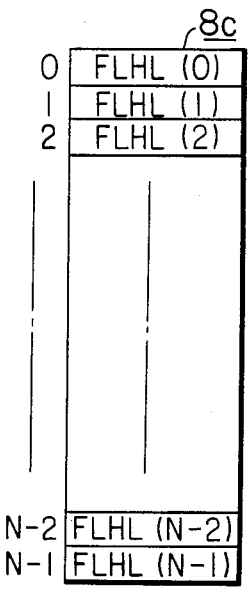

Before the description of the operation, FIG. 7 will be described. FIG. 7(*a*) shows the storage memory addresses of the RAM 8c representing the addresses 0 to N−1 as FLHD(0) to FLHD(N−1) of the lowermost to the uppermost floor for positions located a predetermined distance of 300 mm below the corresponding N floor levels, FIG. 7(*b*) shows the storage memory addresses of the RAM 8c showing the addresses 0 to N−1 as FLHU(0) to FLHU(N−1) of the lowermost to the uppermost floors for positions located a predetermined distance of 300 mm above the corresponding N floor levels, and FIG. 7(*c*) shows the storage memory addresses of the RAM 8c of the addresses 0 to N−1 as FLHL(0) to FLHL(N−1) of the actual floor level values of the corresponding N floors obtained by taking the average of the values stored in FIGS. 7(*a*) and 7(*b*).

When cage 1 is at the lowermost floor, the corresponding actual level value is obtained by (FLHD(0)+FLHU(0))/2, and the result is stored in the address 0 of the RAM 8c as FLHL(0), as shown in FIG. 7(*c*).

When the cage 1 runs upward, the pulses generated from the pulse generator 6 are counted by the counters CT1 and CT2 to measure the running distance of the cage. As shown in FIG. 8, upon the start of the writing and calculating program of the microcomputer 8, the counted values DP1 and DP2 of the counters CT1 and CT2 are input to the microcomputer 8 in step 200 and the reset signal RESET is fed from the microcomputer 8 in the next step 201 to reset the counters CT1 and CT2 and the flip-flops FF1 and FF2. When the resetting operation is finished, the next step 202 determines whether the cage 1 is running upward. In case of a "NO" result, the writing and calculating program is terminated. In case of a "YES", the program advances to step 203 to determine whether the output signal 12a of the position detector 12 increases. In case of a "YES" in step 203, the program advances to step 204 and provides I+1 as a new floor number to be written in the RAM 8c. This corresponds to a position 300 mm below the floor level and is determined by FLHD(I)←FSY+DP2 in the next step 205.

More particularly, the counted value DP2 of the counter CT2 is added to the present position FSY of the cage, determined by accumulating the counted value DP1 of the counter CT1 input at every calculating period of the microcomputer 8 and the running distance of the cage obtained prior to the counted value DP1 of the counter CT1. The result of the addition (FLHD(I)) is written in the address of the RAM 8c corresponding to the Ith floor. As the cage 1 runs further upward, the present floor position FSY←FSY+DP1 is updated in step 206 with the counted value DP1 of the counter CT1 being accumulated and input to the microcomputer 8 at every calculating period of the microcomputer 8.

On the other hand, in case of a "NO" result in step 203, the program advances to step 207 to determine whether the output signal 11a of the position detector 11 decreases. In case of a "NO", the program advances to step 206 to determine the present position of the cage. Otherwise, the program continues in step 208 to determine the floor position FLHU(I)←FSY+DP2 in relation to a position 300 mm above the floor level of the Ith floor.

More particularly, the counted value DP2 of the counter CT2 is added to the present position value FSY of the cage determined by accumulating the counted value DP1 of the counter CT1 input at every calculating period of the microcomputer 8. The result of the addition (FLHU(I)) is written in the address of the RAM 8c corresponding to the Ith floor.

The program then advances to step 209 to determine the actual level value of the Ith floor according to an average FLHL(I)←(FLHD(I)+FLHU(I))/2. In other words, the average value of the position values for positions 300 mm above and below a floor is obtained and stored in the corresponding address of the RAM 8c as the accurate actual level value for that floor.

Similarly, the writing and calculations from steps 200 and 209 are repeated for subsequent floors up to the uppermost floor so that all actual level values of respective floors of the building are determined and stored in the RAM 8c, as shown in FIG. 7(*c*).

In the apparatus described above, even if the cage is displaced from the actual floor level position, the position of the cage can be accurately corrected. In other words, the operating point of the position detector is, for example, 300 mm above or below the floor by the plate 10, and is longer than the door zone. Therefore, when the position detector passes the plate 10, such as when the cage, for example, runs upward from the Ith floor, the decrease of the output signal 11a of the position detector 11 is detected by the microcomputer 8 to calculate FSY←FLHU(I)+DP2. When the cage passes the Ith floor, the decrease of the output signal 12a of the position detector 12 is detected to calculate FSY←FSHD(I+1)+DP2, and the decrease of the output signal 11a of the position detector 11 is detected to calculate FSY←FSHU(I+1)+DP2, thereby correcting the position of the cage.

Furthermore, while the apparatus of the present invention detects the running position of the cage along a hoistway path formed of the cage 1, the cable 3, the sheave 4, the motor 5, and the pulse generator 6, the values FLHD(I), FLHU(I), and FLHL(I) stored in the RAM 8c are continuously updated and corrected in relative terms and hence unaffected by changes, such as the length of the cable 3 or the wear of the sheave due to extended use or heavy load. In other words, the distance per one pulse may change as a result of equipment deterioration, but this change only increases or decreases at a constant ratio. Therefore, the levels of the respective floors always exhibit correct values.

According to the present invention as described above, the apparatus obtains the levels of the respective floors by the average value of the detected positions of points above and below each floor by writing the positions of the points (e.g., 300 mm above or below the floor) for the respective floors in the RAM. Therefore, the levels of the respective floors stored in the RAM can be accurately obtained and, even if the cage is displaced from a floor level, the position of the cage can be accurately corrected.

In the apparatus for controlling the elevator according to the embodiment described above, the position detectors 11 and 12 generally have considerable response delay, and, when the response delay is represented by $\Delta T$, an error in the distance of $V \times \Delta T$ (V represents the velocity of the cage) occurs. As a result, in order to reduce the above-described error, the cage 1 must be operated at a low speed, and, in a building with wide separation in floor levels, the time required to write the floor number values is often long. On the other hand, to write the floor number values while operating the cage at high speed, position detectors with sufficiently fast responding speed must be employed, resulting in high equipment cost.

A second embodiment of the present invention provides an apparatus for controlling an elevator capable of accurately writing the floor number values in the memory while operating the cage at a high speed even when position detectors having considerable response delay are employed.

In order to achieve the above-described object, the present invention compensates for the considerable response delay of the detectors by changing the distance adjustment value in accordance with the moving speed of the cage.

Figure 9:
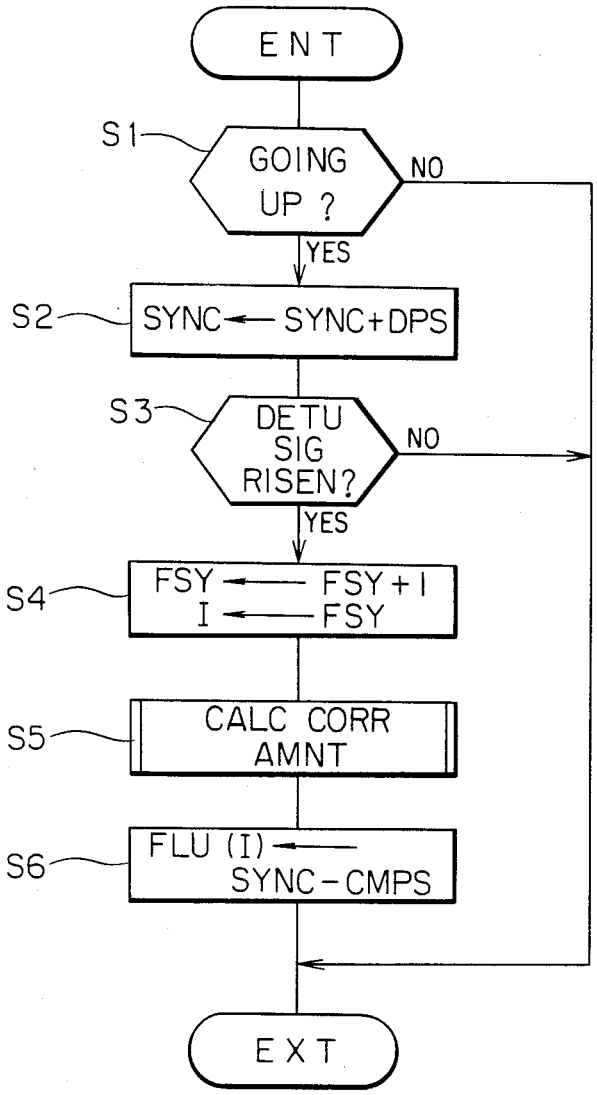
FIG. 9 is a flow chart showing the program used for an apparatus for controlling an elevator according to a second embodiment of the present invention.

FIG. 9 shows a flow chart of sequence program steps for controlling an elevator according to the second embodiment of the present invention. It is noted that these program steps are stored in a read-only memory 8b of the microcomputer 8.

In FIG. 9, step $S_1$ decides whether the cage 1 moves upward. In case of a "NO", the controlling program is exited and terminated, while in case of a "YES", the program advances to step $S_2$. In step $S_2$, the output value DPS of the counter 7 is added to the present position value SYNC of the cage 1, the added result is written as the new SYNC value, and the program then advances to step $S_3$. Step $S_3$ decides whether the output signal 11a of the position detector 11 increases. In case of a "NO", the program is exited and terminated, while in case of a "YES", the program advances to step $S_4$. In step $S_4$, after a value of 1 is added to the present position FSY of the cage 1, it is stored as a dummy variable I. Then, in step $S_5$, a subroutine program for calculating a distance adjustment value CMPS in response to the moving speed of the cage 1 is executed, and, in step $S_6$, this adjustment value CMPS is subtracted from the present position value SYNC to obtain FLU(1) and the program is terminated.

Figure 10:
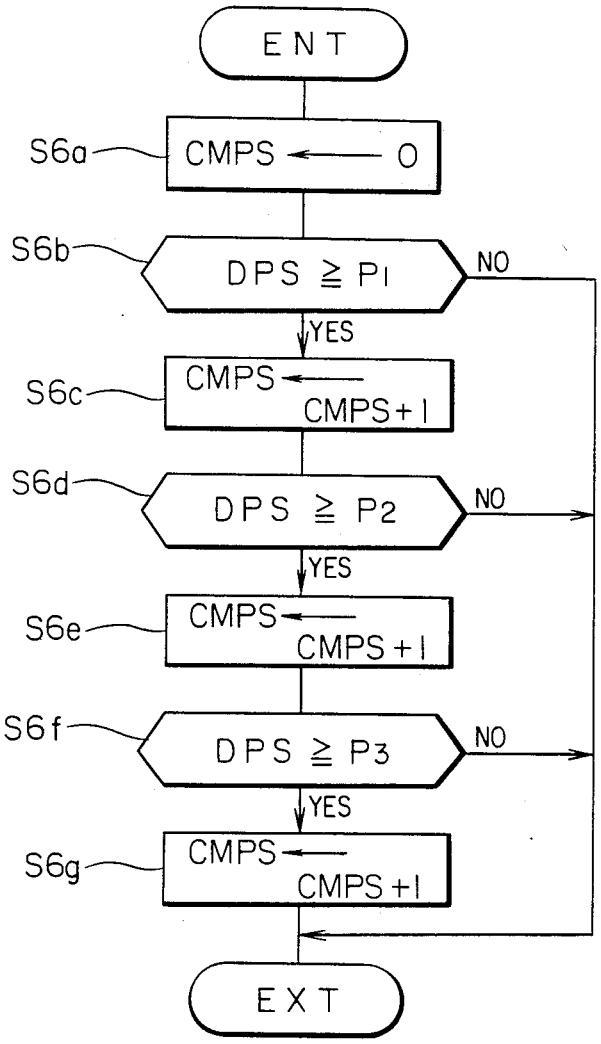
FIG. 10 is a flow chart showing the detail of a correcting amount calculating subroutine of FIG. 9.

FIG. 10 shows the detailed sequence steps of the subroutine program referred to in step $S_5$ of FIG. 9. First, in step $S_{6a}$, the distance adjustment value CMPS is set to zero and the program advances to step $S_{6b}$. Here, the output value DPS of the counter 7 represents the moving distance of the cage 1 in a corresponding calculating period of the central processing unit 8a, and, since the period of the unit 8a is always the same, DPS also represents the speed of the cage. Consequently, when the steps $S_{6b}$ to $S_{6g}$ shown in FIG. 10 are executed, the distance adjustent value CMPS becomes "0" for $DPS<P_1$, "1" for $P_1 \leqq DPS<P_2$, "2" for $P_2 \leqq DPS<P_3$, and "3" for $P_3>DPS$. In other words, since the response delay time $\Delta T$ of the position detector 11 is always constant, accurate correction of the position can be performed by setting the distance adjustment value to 0 to 3 pulses in response to the speed of the cage. Further, in the embodiment described above, the up-running operation of the cage has been described. However, accurate correction of the position can also be performed similarly by the same process for a cage moving in a downward direction.

In the controlling apparatus according to the second embodiment of the invention as described above, the distance adjustment value of the distance is set in response to the moving speed of the cage. Therefore, even if a time response delay occurs in the position detectors, the present position of the cage can be accurately detected. Thus, the apparatus of this embodiment can provide advantages in that, even when inexpensive position detectors of slow responding speed are employed, the floor number values can be accurately written in the memory while operating the cage at a high speed.

In the embodiments of the invention described above, the moving distance of the cage 1 is not directly measured but is indirectly measured from the rotating speed of the motor 5. Therefore, errors are accumulated due to the slip of the cable 3 and the reduction in the diameter of the sheave 4 due to wear and extended use. Thus, in the apparatus for controlling the elevator of the invention, the output signals 11a and 12a of the position detectors 11 and 12 are supplied to the central processing unit 8a, thereby correcting the present position SYNC. For example, when the position detector 11 is advanced to the plate of the Ith floor during an upward run to generate the output signal 11a, SYNC←FLU(I) is executed. Further, when the position detector 12 is advanced to the plate 10 of the Ith floor during a downward run to generate the output signal 12a, SYNC←FLD(I) is executed.

However, in the above correcting method, an error of the distance of $V \times \Delta T$ occurs because of the response delay of the position detectors 11 and 12, where V represents the speed of the cage and $\Delta T$ represents the response delay time of the detectors 11 and 12. Therefore, in the above-described correcting method, drawbacks are raised, for example, that sufficient correction cannot be provided in an elevator at high speed, or an expensive position detector must be employed to reduce the response delay.

A third embodiment of the present invention for solving the above drawbacks will be described.

Figure 11:
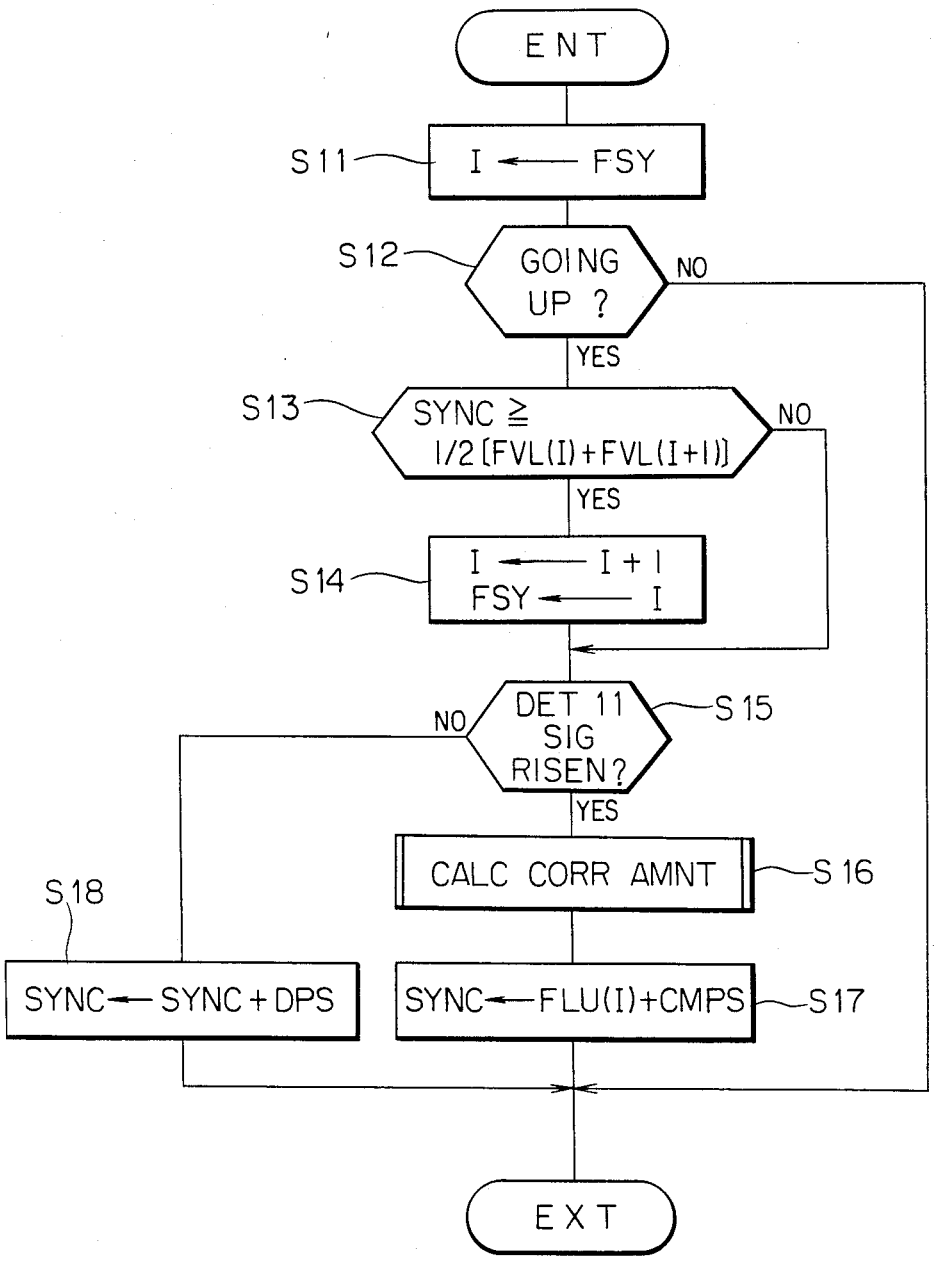
FIG. 11 is a flow chart showing the program used for an apparatus for controlling an elevator according to a third embodiment of the present invention.

FIG. 11 shows a flow chart of sequence program steps for controlling an elevator according to this embodiment. It is noted that these steps are stored in a read-only memory 8b of the microcomputer 8.

In FIG. 11, step $S_{11}$ advances to step $S_{12}$ after the present position FSY is stored in memory as a dummy variable I. Step $S_{12}$ decides whether the cage 1 moves in an upward direction. In the case of a "NO", the program is exited and terminated, while in case of a "YES", the program advances to step $S_{13}$. Step $S_{13}$ decides whether the present position SYNC of the cage 1 is above $(FVL(I)+FVL(I+1))/2$, and hence whether the cage 1 passes the intermediate postion between the floor and the next floor. In case of a "YES", the program advances to step $S_{14}$ where a value of 1 is added to the dummy variable I to become the present position FSY of the cage 1, and the program advances to step $S_{15}$. In case of a "NO" in step $S_{13}$, the program immediately advances to step $S_{15}$. The step $S_{15}$ decides whether the output signal 11a of the position detector 11 increases. In case of a "YES", the program advances to step $S_{16}$. Step $S_{16}$ executes a subroutine program for deciding a distance adjustment value CMPS in response to the speed of the cage, and then advances to step $S_{17}$. Step $S_{17}$ corrects the present position SYNC of the cage 1 by using the correcting amount CMPS calculated in the step $S_{16}$ and the program is terminated. In case of a "NO" in the step $S_{15}$, the counter DPS is added to the present position SYNC of the cage 1 in step $S_{18}$, and the correction of the present position SYNC of the cage is not necessary.

Step $S_{16}$ operates the same as that in FIG. 10 and will be omitted in the description.

With this embodiment, the present position of the cage can be accurately corrected by the above-described calculation.

What is claimed is:

1. In an apparatus for controlling an elevator cage moving in a hoistway between a plurality of floors, the combination comprising:

a pulse generating means for generating signal pulses responsive to vertical movement of the cage in the hoistway, a plurality of plates provided in the hoistway, each plate corresponding to one of the floors, position detector means including detectors provided on the cage and movable upon movement of the cage into positions opposite to said plates for detecting the positions of the floors corresponding to said plates based on the positions of the cage and for generating position signals representing a predetermined point located a predetermined distance above each actual floor level and a predetermined point located a predetermined distance below each actual floor level, memory means for storing data representing the positions of the cage and the floors, first means for calculating the positions of the predetermined points on the basis of number of pulses generated from said pulse generating means and accumulated when a signal representing a predetermined point above a floor and a predetermined point below a floor is generated, and for storing data in said memory means representing the calculated positions of the predetermined points, and second means for calculating data as to the actual levels of the respective floors on the basis of the calculated positions of the predetermined points and storing the data as to calculated actual floor levels in said memory means.

2. An elevator control apparatus according to claim 1 wherein said second means calculates an average value of the positions of the predetermined points calculated by said first means to determine actual floor levels.

3. Apparatus for controlling an elevator cage as set forth in claim 1 wherein said position detector means detectors generate a position signal when the cage is located at a position within the predetermined distance above or below each actual floor level.

4. An elevator control apparatus according to claim 1 wherein said position detector means includes two detecting elements for detecting the predetermined points above and below a floor on the basis of the detection or nondetection of a corresponding plate generated from the two detecting elements.

5. In an apparatus for controlling an elevator cage the combination comprising:

pulse generating means for generating signal pulses responsive to movement of the cage in a hoistway, position detectors mounted on the cage for detecting plates secured in a hoistway, each plate corresponding to one of the floors, a memory means for storing values representing the data including preset positions of the respective floors, operating position detecting means for detecting the position of the cage by counting and accumulating the pulses generating from said pulse generating means, setting means for setting an operating position value representing the operating position of the cage based upon the output of said position detectors, and means for resetting the operating position value of the cage by adding or subtracting to or from the operating position value an adjustment value which is preset and corresponds to the speed of the cage determined from an output from said pulse generating means.

6. In an apparatus for controlling an elevator cage moving in a hoistway between a plurality of floors, the combination comprising:

pulse generating means for generating signal pulses responsive to vertical movement of the cage in the hoistway, position detectors mounted on the cage for detecting plates secured in the hoistway, each plate corresponding to one of the floors and providing signals representing operating position of said position detectors relative to the floors, a memory means for data representing the positions of the floors, means actuated in response to said position detectors for storing data in said memory means representing the operating position of said position detectors with respect to the floors, and means for correcting data stored in said memory means as to the operating positions of said position detectors in response to the speed of the cage by adding or subtracting an adjustment value corresponding to the speed of the cage to or from a value representing the operating position of said position detector.

7. An elevator control apparatus according to claim 6 wherein:

said correcting means adds or subtracts a larger distance adjustment value when the moving speed of the cage is high than when the moving speed of the cage is low.

* * * * *